United States Patent [19]

Bolich

[11] Patent Number: 4,955,566

[45] Date of Patent: Sep. 11, 1990

[54] BAG HOLDING SYSTEM

[76] Inventor: Donald L. Bolich, 1136 Birdie Rd., Broomfield, Colo. 80020

[21] Appl. No.: 420,911

[22] Filed: Oct. 13, 1989

[51] Int. Cl.[5] ..... B65B 67/04

[52] U.S. Cl. ..... 248/101

[58] Field of Search ..... 248/99, 100, 101, 97, 248/98, 900

[56] References Cited

U.S. PATENT DOCUMENTS

| | | | |
|---|---|---|---|
| 1,158,013 | 10/1915 | Vonderahe | 248/99 |
| 1,439,878 | 12/1922 | Erhardt et al. | 248/101 |
| 3,468,505 | 9/1969 | Reilly | 248/101 |
| 3,838,839 | 10/1974 | Spencer | 248/97 X |
| 3,841,592 | 10/1974 | Witten | 248/101 |
| 3,870,261 | 3/1975 | McSwain | 248/101 |
| 4,223,858 | 9/1980 | Salazar | 248/101 |
| 4,669,690 | 6/1987 | McEniry | 248/101 |

FOREIGN PATENT DOCUMENTS

| | | | |
|---|---|---|---|
| 968738 | 9/1964 | United Kingdom | 248/101 |

*Primary Examiner*—David M. Purol

*Attorney, Agent, or Firm*—Donald W. Margolis

[57] ABSTRACT

A system for supporting and holding open a container is provided which includes a mounting element which is adapted to be secured to a support, such as a vertical surface, and a mechanism to receive and hold a bag in an open position. The bag receiving and holding mechanism is pivotally connected to the mounting element. A biasing mechanism, with a predetermined load bearing capacity, is connected between the mounting element and the receiving and holding mechanism in a manner such that the receiving and holding mechanism is normally oriented in a substantially horizontal position above a floor. When a bag is held in place in the system and a load is placed in the bag, such that the bag and its load exceed the load bearing capacity of the biasing mechanism, the biasing mechanism will be overcome; thereby, allowing the receiving and holding mechanism to pivot downwardly so that the bag can be supported by the floor or the wall on which the system is mounted.

16 Claims, 4 Drawing Sheets

BAG HOLDING SYSTEM

BACKGROUND OF THE INVENTION (a) Field of the Invention

This invention relates to systems for supporting a container, and for holding open such a supported container. More specifically, it relates to such a support which includes a frame for clamping the mouth of the container in an open position.

(b) Discussion of the Prior Art

Containers for supporting a bag, in which the mouth of the bag is maintained open and horizontal so that it can readily receive material to be inserted in the container are well known in the art. Such prior art bag holders normally maintain their horizontal position during the entire loading process. For example, Milks U.S. Pat. No. 1,121,388, issued Dec. 18, 1914, discloses a vertical mounted bag holder that clamps a bag in an open position. The bag holding element of this patent is in a rigid position and can not move relative to its vertical mounting plate. Reilly U.S. Pat. No. 3,468,505, issued Sept. 23, 1969, discloses a bag holder which consists of a vertical mounting plate and two rings to clamp a bag in place. In this reference, the top ring is hinged so that it can move pivotally upwards for ease in loading an empty bag onto the bottom ring, or for removing a full bag therefrom. Whitten U.S. Pat. No. 3,841,592, issued Oct. 15, 1974, discloses a bag holder which includes a bag holding hoop which is normally rigidly retained in a horizontal position, but which hoop can be manually disengaged to allow it to pivot downward so that the entire bag holding hoop may be folded down and out of the way when the system is not in use. During the loading of the bag of this reference the hoop is in a rigid horizontal position, and is only pivoted downwards when it is not in use.

Other prior art which discloses various related bag holders includes Govoni U.S. Pat. No. 3,773,286, issued Nov. 20, 1973; Presinger U.S. Pat. No. 4,124,185, issued Nov. 7, 1978; Salazar U.S. Pat. No. 4,223,858, issued Sept. 23, 1980; Christensen U.S. Pat. No. 4,378,924, issued April 5, 1983; and Garvey U.S. Pat. No. 4,488,697, issued Dec. 18, 1984.

As is apparent from the many prior art patents relating to bag holders, and as illustrated by the various different solutions exemplified in the cited references and other known prior art, the problem of supporting a bag in an open position has been long-standing, and its solution has been subject to many different approaches, some of which are complex and costly. The above listed prior art clearly demonstrates that there remains at least one drawback with which open ended container holders have not dealt with to date. That problem is that as the container is filled with material, the load will increase in weight. As this occurs, the load acting upon the fasteners, which attaches the system to the vertical support, increases. Therefore, at a certain point, depending on the materials being put into the container, the increased load acting on the fasteners may cause the fasteners to fail or pull from the wall, thereby causing the system to fall to the floor, with possible damage to the system and to the support wall.

It is thus seen that it would be desirable to have a simple, inexpensive system for holding a bag in an open position for the collection of refuse or other material, which system would relieve the strain of a heavy load in a bag, for example by pivoting in a downwards direction when the weight of the bag and its contents reaching a certain predetermined load.

SUMMARY OF THE INVENTION

In view of the foregoing, it is an object of the present invention to provide a simple system for holding a bag in an open position for the collection of refuse or other material.

It is another object of the present invention to provide such a system which will pivot downward when the weight of a load in a bag exceeds the load bearing capacity of a biasing mechanism, such as a spring.

Another object of the present invention is to provide a system for holding a bag in an open position, which system is simple in construction and design and which lends itself to the easy collection of material.

It is yet another object of the present invention to provide a simple, inexpensive system for holding a bag in an open position which will allow the portion of the system which is supporting the bag to pivot downwards when the load of the bag and its contents overcomes the predetermined load bearing capacity of a biasing mechanism, such as a spring.

The foregoing objects of the present invention are obtained by providing a system which is capable of being mounted on a support structure, such as a vertical wall, which system is designed to support an open ended container and any contents placed into that open ended container. The system includes a mounting element which is adapted to be secured to a vertical wall surface or other support structure. It also includes a rings or hoop for holding and receiving a container in an open position. The holding and receiving device is connected to the mounting element in a manner such that the holding and receiving device is oriented in a substantially horizontal position, and where the mounting element is vertical, is also substantially perpendicular to the mounting element.

As an improvement, the present invention includes a mechanism for pivotally connecting the holding and receiving device to the mounting element and a mechanism, such as a spring, for biasing the holding and receiving mechanism into its normal substantially horizontal position. This biasing mechanism is connected between the mounting element and the holding and receiving mechanism. In preferred embodiments the biasing mechanism has a predetermined load bearing capacity which will be overcome when the weight of the load of the container and its contents exceeding the load bearing capacity of the biasing mechanism. The result is to cause the holding and receiving mechanism to pivot downwards from its normal substantially horizontal position.

In one preferred embodiment of the invention the system is biased by a coil spring which interacts with the mounting element and the holding and receiving mechanism. As detailed below, such a biasing mechanism allows the holding and receiving means to pivot downwards relative to the mounting element upon the load bearing capacity of the biasing mechanism being overcome by the load of the bag and its contents.

In preferred embodiments, the holding and receiving means includes a frame ring with an opening sized to receive the open end of a bag passed upwardly therethrough and a retaining ring which snugly surrounds the frame ring over which the open end of the bag is folded.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DETAILED DESCRIPTION OF THE PREFERRED EMBODIMENT

Figure 1:
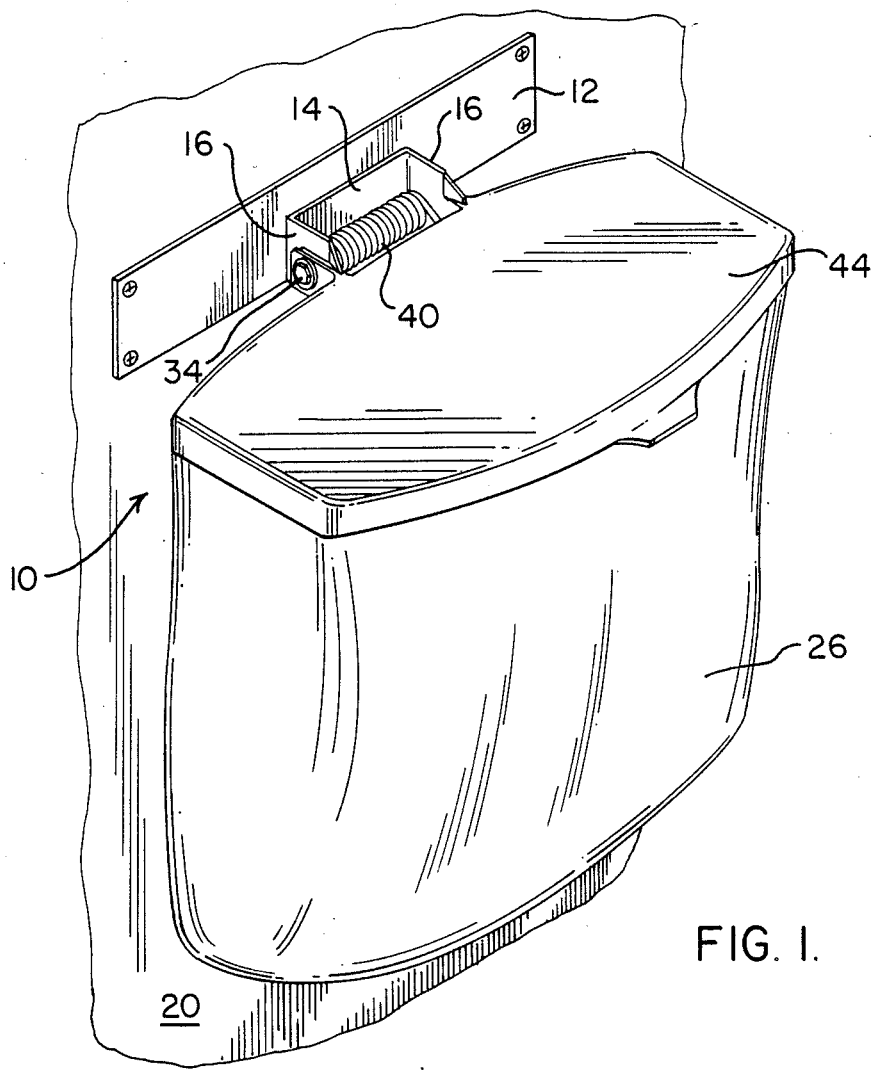
FIG. 1 is a top perspective view of the system of the present invention which is adapted to support a container and its contents, shown mounted on a support with a container in place.
Figure 3:
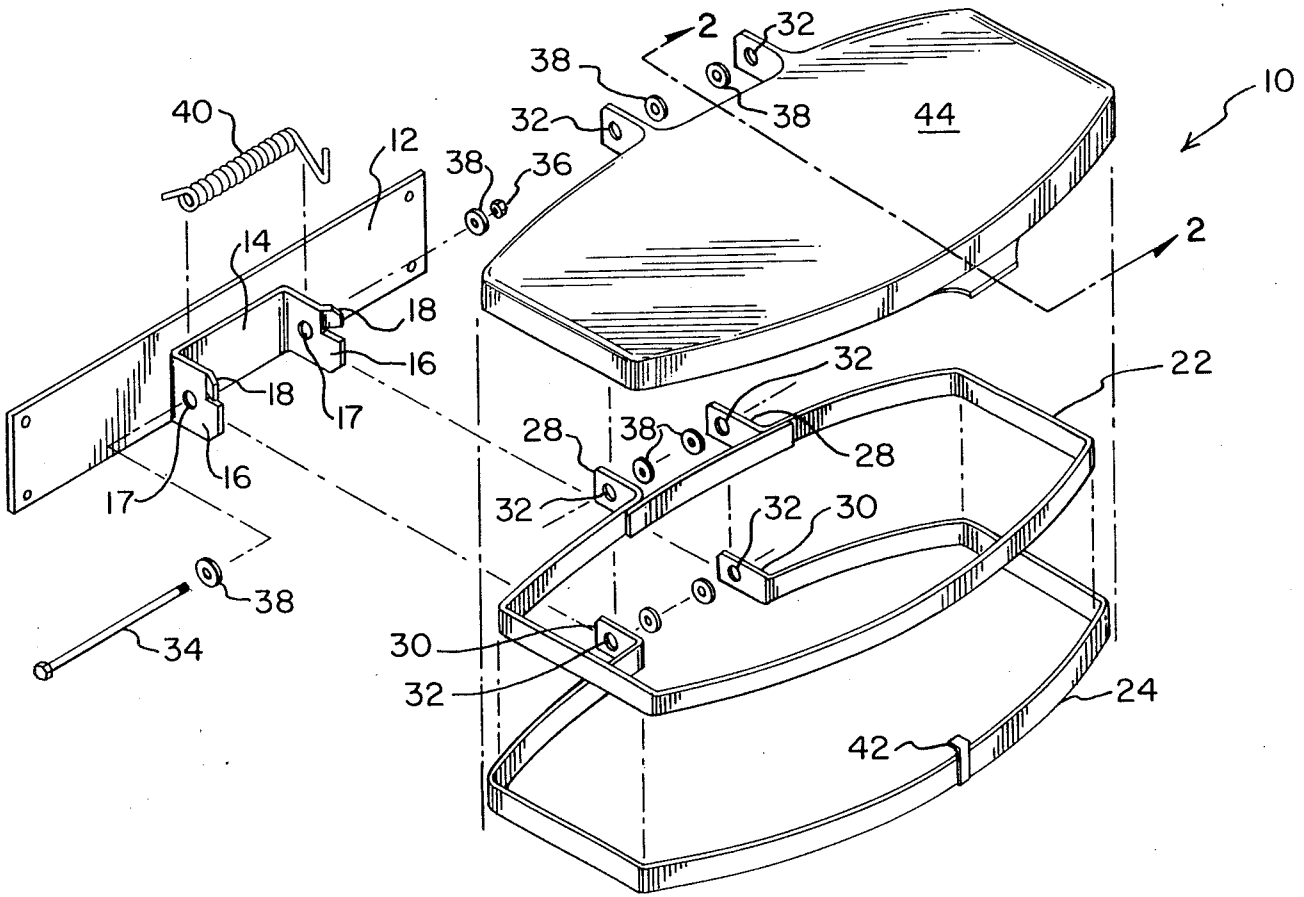
FIG. 3 is an exploded perspective view showing the elements of the support system of the present invention.
Figure 5:
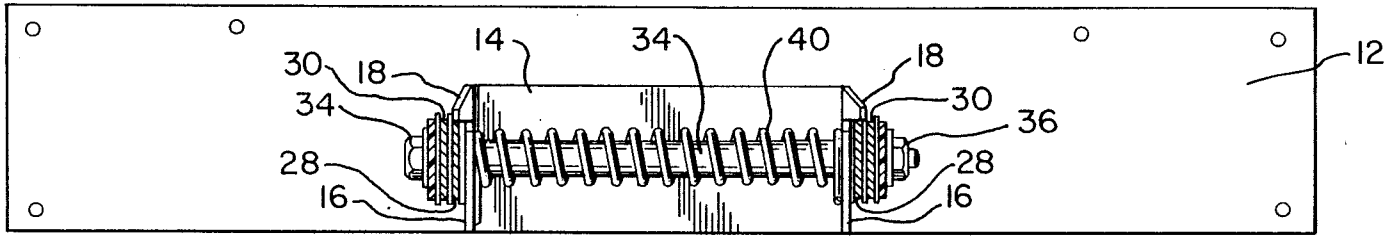
FIG. 5 is an elevational front view showing additional details of the various pivotally connecting and biasing elements of the device of the present invention taken along line 5—5 of FIG. 4.
Figure 4:
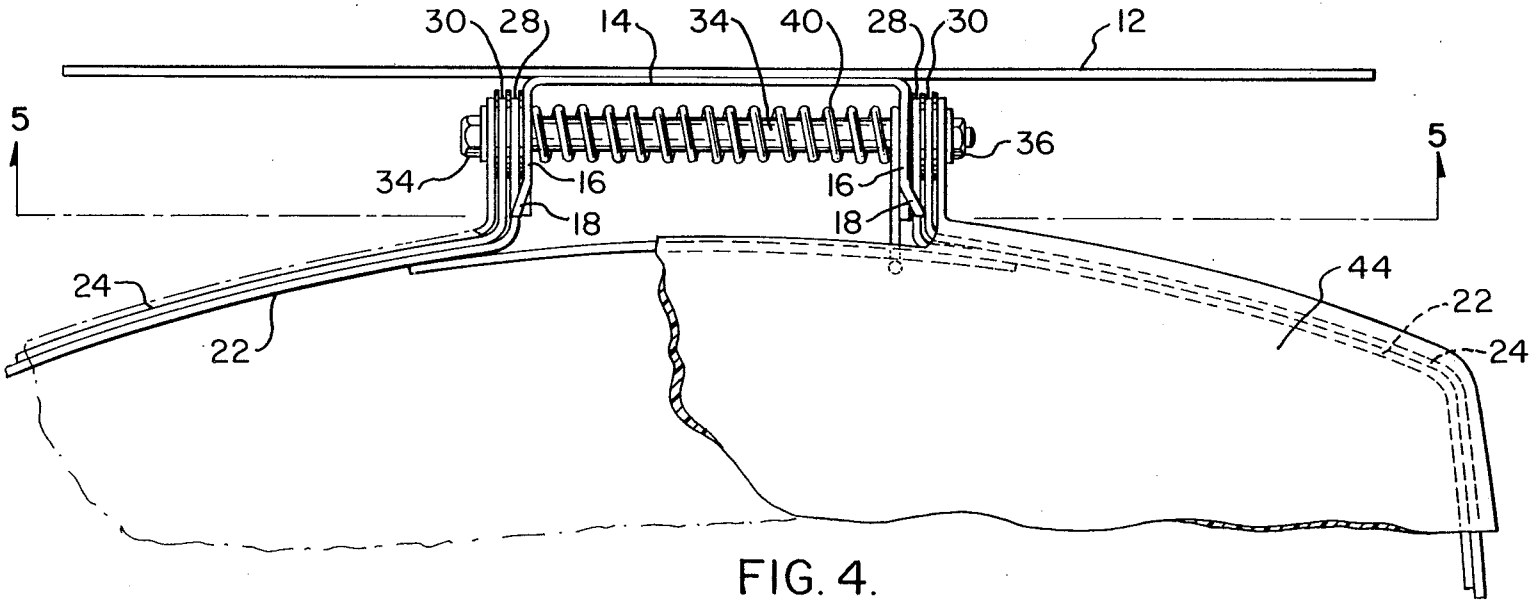
FIG. 4 is an enlarged top plan view, partially in phantom, showing the details of the various pivotally connecting and biasing elements of the device of FIG. 1.
Figure 6:
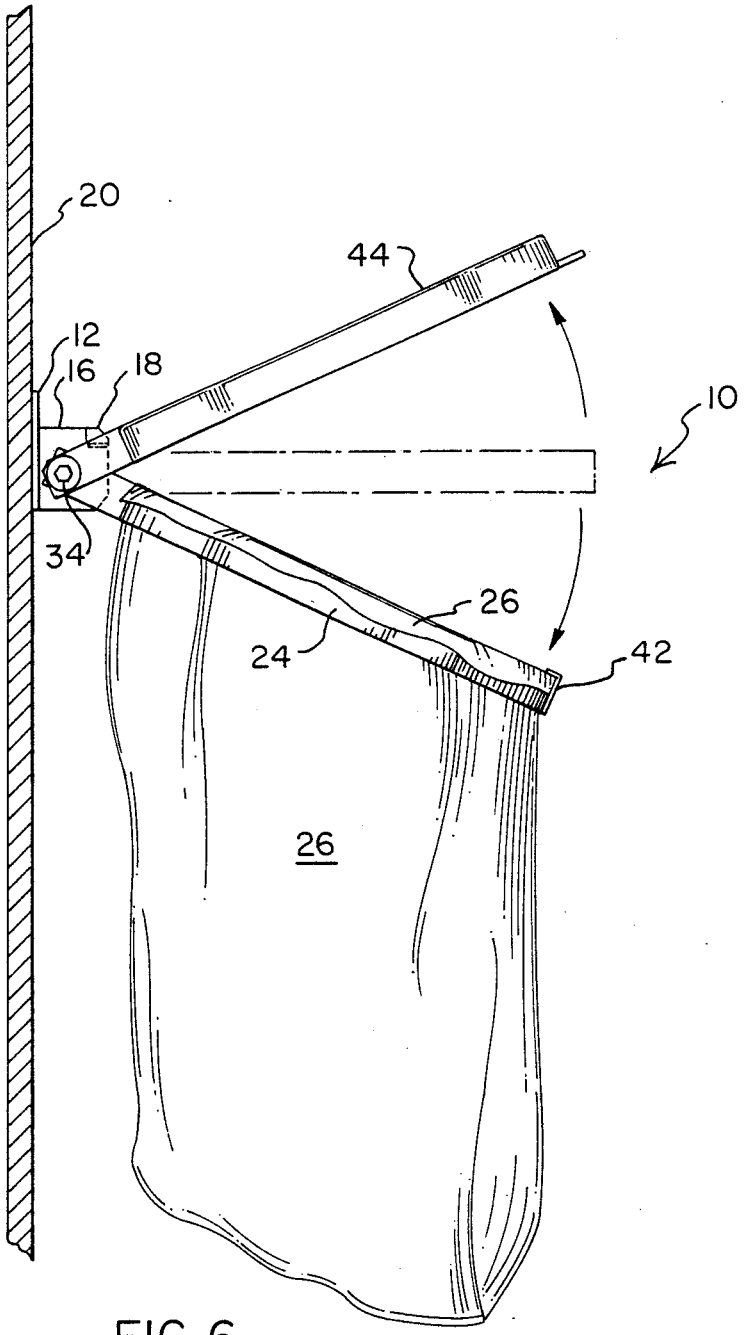
FIG. 6 is a side elevational view of the present invention mounted on a support wall shown in cross section and with the supporting and holding mechanism shown in phantom in its normal horizontal position, and illustrating its pivotal downward movement in response to the load in the container exceeding the load bearing capacity of the biasing mechanism.

Referring initially to FIGS. 1, 3 and 6 the preferred embodiment of the bag holder of the present invention, designated generally as 10, is illustrated. Each bag holder 10 includes a mounting member 12 and a collar 14 securely fastened to one side of mounting member 12. Collar 14 includes a pair of aligned spaced apart arms 16. Apertures 17 and stop 18 is integrally carried by each arm 16. Each stop 18 is shown as protruding outward away from the center of collar 14.

Mounting member 12 is preferably a flat plate and is mounted on a substantially flat vertical surface, such as a wall, but it may be designed to be mounted, either by itself or with auxiliary hardware, to almost any support system. In the embodiment shown in FIG. 6, mounting member 12 is shown secured to a substantially flat vertical wall surface 20. While not shown, such attachment of mounting member 12 to wall 20 or other support systems can be achieved using a plurality of bolts or other fastening devices, for example through the holes illustrated in mounting member 12, although any other type of fastening mechanism or device may be utilized for this purpose.

Figure 2:
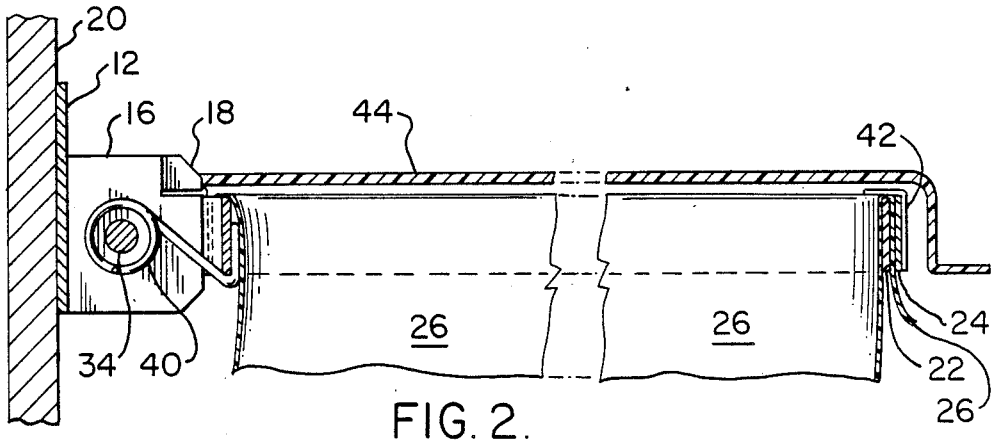
FIG. 2 is an enlarged partial sectional view taken along line 2—2 of FIG. 1 and showing additional details of the support system.

A bag holding and receiving system is pivotally connected to mounting member 12. The holding and receiving system preferably includes a frame ring 22 and a retaining ring 24. As illustrated, and as discussed in greater detail below, in practice a flexible container, such as bag 26 is inserted, open end up, through the central opening in frame ring 22 and draped outwardly over frame ring 22. Retaining ring 24 is then placed over frame ring 24 to secure bag 26 against slippage off of frame ring 22. As illustrated, the outer circumference of frame ring 24 is less than the inner circumference of retaining ring 24. Thus, frame ring 22 fits within retaining ring 24 as illustrated in FIG. 2 to define a narrow passageway through which bag 26 may pass and yet be snugly retained.

The pivotal connection between frame ring 22 and retaining ring 24 and mounting member 12 is preferably in the form of a hinge, although any type of pivotal connection may be utilized for this purpose. In the preferred embodiment frame ring 22 and retaining ring 24 each carry a pair of spaced apart aligned arms 28 and 30, respectively, each arm carrying an opening 32. Hinge pin 34 passes through apertures 17 of collar 14 and apertures 32 of arms 28 and 30, and is then securely fastened on one end by threaded nut 36. As seen in FIG. 3, spacers 38 can be placed on hinge pin 34 between collar 14 and holding and arms 28 of retaining ring 24, to thereby allow for unhindered movement of frame ring 22 and retaining ring 24 relative to collar 14. Spacers 38 are preferably in the form of washers, although any type of spacing element may be utilized for this purpose.

A biasing member 40 is connected between the mounting member 12 and frame ring 22. Biasing member 40 is preferably a spring. While any type of spring bias arrangement may be utilized, FIG. 3 illustrates a coil spring 40 which is wrapped around hinge pin 34. Coil spring 40 has a first end which is connected to mounting member 12 and a second end which is connect to frame ring 22, to thereby bias frame ring 22 and associated retaining ring 24 upwards against stops 18 of arms 16. As illustrated in FIG. 3, stops 18 intersect with a portion of frame ring 22 to provide a catch which prevents ring 22 from pivoting upwards beyond a normal substantially horizontal position.

Spring 40 also possesses a predetermined load bearing capacity. As materials are placed in bag 26 the weight of bag 26 is increased. Eventually the weight of the bag 26 and its contents may exceed the load bearing capacity of spring 40. When this occurs it causes the frame ring 22 and associated retaining ring 24 to pivot downwards from its normal horizontal position. By allowing holding and receiving means 20 to pivot downward bag 26 will eventually come to rest either against the floor or the support, thereby reducing the torque experienced by the fasteners which connect mounting member 12 to its support structure. Such a reduction in torque will normally prevent mounting member 12 from being inadvertently disconnected from the support structure to which it is connected.

Retaining ring 24 is shown as including a finger 42 which protrudes inward from the top of retaining ring 24. Finger 42 serves two functions. In order to retain the bag in the open position and secured within bag holder 10, retaining ring 24 is placed over frame ring 22 until finger 42 comes to rest upon the open end of bag 26 which is draped outwardly over frame ring 24. As material is placed into bag 26 and the weight in bag 26 is increased, a downward force is exerted on bag 26 which tends to pull the draped portion through rings 22 and 24. Initial small movement of the draped portion causes bag 26 to be wedged between the rings and against finger 42 to thereby firmly retain bag 26 between the rings. In addition, finger 42 prevents retaining ring 24 from rotating below frame ring 22, while allowing retaining ring 24 to rotate downwardly with frame ring 22 when frame ring 22 is caused to rotate downwardly by the weight of material in bag 26.

A lid or cover 44 is pivotally secured to mounting member 12. When not in an open position, lid 44 rests upon rings 22 and 24, holding and receiving means 20. Lid 44 is designed and adopted to substantially cover and enclose frame ring 22 and retaining ring 24, as well as the open end of any bag 26 which is being held by the system.

Lid 44 and rings 22 and 24 may be of substantially any closed loop shape. Lid 44 may even be provided with a handle. Similarly, mounting member 12 and the other various components of bag holder 10 may be constructed from a wide variety of materials which are capable of maintaining their function and their integrity under the potentially extreme loads experienced by bag holder 10.

It is thus seen that the present invention provides a simple system for holding a bag in an open position for the collection of refuse or other material, and which is simple in construction and design and which lends itself to the easy collection of material. It also provides a system which will pivot downward when the weight of a load in a bag exceeds the load bearing capacity of a biasing mechanism, such as a spring.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A system adapted to support a container and its contents on a support structure above the floor comprising:

a mounting element;

means for holding and receiving a container;

hinge means for pivotally connecting said holding and receiving means to said mounting element;

a hinge pin, said hinge pin being included as a portion of said hinge means, and a coil spring for biasing said holding and receiving means into a first normal substantially horizontal position, said coil spring being wrapped around said hinge pin, said coil spring having a first end and a second end, said first end of said coil spring being connected to said mounting element, and said second end of said coil spring being connected to said means for holding and receiving a container, said coil spring having a given load bearing capacity, said coil spring being adapted to be overcome when the load of a holding and receiving means and a container and its contents exceed the given load bearing capacity of said coil spring, to thereby allow said supporting and holding means to pivot downwards from its normal substantially horizontal position so that a container and its load can be supported by the floor or the support structure on which the system is mounted.

2. The container holding system as defined in claim 1, wherein said mounting element includes means for attaching said mounting element to a support structure.

3. The container holding system as defined in claim 1, wherein said mounting element is in the form of a mounting plate including a first side adapted to contact a support structure, and a second side opposed to said first side.

4. The container holding system as defined in claim 3, wherein said mounting plate includes means for attaching said second side of said mounting plate to a vertical surface of a support system in a manner such that said mounting plate is in a substantially vertical orientation.

5. The container holding system as defined in claim 1, wherein said hinge means for pivotally connecting said holding and receiving means to said mounting element includes a first portion of a hinge secured to said second side of said mounting plate, and a second portion of a hinge secured to said means for supporting and holding a container; and wherein further, means for connecting said first and second hinge portions are provided.

6. The container holding system as defined in claim 5, wherein one said hinge portion includes at least two spaced apart arms and said other hinge portion includes at least one arm, said hinge portions being designed and adapted to be juxtaposed together form a hinge.

7. The container holding system as defined in claim 6, wherein each said arm included in each such hinge portion defines at least one opening therethrough, said openings being substantially axially aligned when said arms are juxtaposed and aligned, and wherein said hinge pin passes through said axially aligned openings in said arms.

8. The container holding system as defined in claim 7, wherein said pin is secured to maintain its position through said axially aligned openings in said arms, and to thereby also maintain the axial alignment of said holes in said arms when said arms are so juxtaposed.

9. The container holding system as defined in claim 3, wherein said mounting element includes a stop which is supported by said second side of said mounting element, and said supporting and holding means includes catch means, said catch means being aligned with said stop in such a manner that when said biasing means biases said supporting and holding means upwards said catch means meets said stop to thereby prevent said supporting and holding means from pivoting upwards beyond a substantially horizontal position.

10. The container holding system as defined in claim 1, wherein said supporting and holding means comprises a rigid frame ring having a central opening for receiving an open flexible container therethrough and draping such a container thereover, and a retaining ring for securing such a draped container to said frame ring, both said frame ring and said retaining ring being pivotally connected to said mounting element.

11. The container holding system as defined in claim 10, wherein said retaining ring is also rigid.

12. The container holding system as defined in claim 11, wherein the outer circumference of said frame ring is slightly less than the inner circumference of said retaining ring, whereby said frame ring fits within said retaining ring to define a narrow passageway through which a container may pass and be retained.

13. The container holding system as defined in claim 12, wherein at least one of said rings further includes means for preventing said retaining ring from rotating down past said frame ring.

14. The container holding system as defined in claim 13, wherein said means for preventing said retaining ring from rotating down past said frame ring includes a finger which protrudes inwardly from the top of said retaining ring; wherein said retaining ring is placed over said frame ring until said finger is supported by said frame ring, whereby said retaining ring is kept from rotating down past said frame ring, and wherein further, a container supported by said frame ring is retained in the open position and secured within the system.

15. The container holding system as defined in claim 14, wherein a lid is pivotally secured to said mounting element by means of hinge, said lid being designed and adopted to substantially cover and enclose said frame ring, said retaining ring, as well as the open end of any container which is held by the container holding system.

16. The container holding system as defined in claim, 1, wherein a lid is pivotally secured to said mounting element, said lid being designed and adopted to substantially cover said means for receiving and holding a container as well as the open end of any container which is held by the container holding system.

* * * * *